US006030034A

United States Patent [19]

Plohetski

[11] Patent Number: 6,030,034

[45] **Date of Patent: *Feb. 29, 2000**

[54] LOUNGE CHAIR ACCESSORY

[75] Inventor: John R. Plohetski, Coppell, Tex.

[73] Assignee: Blue Sky Products, Coppell, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/845,537

[22] Filed: Apr. 25, 1997

[51] Int. Cl.[7] ..... A47C 7/62

[52] U.S. Cl. ..... 297/188.06; 297/397; 297/229; 297/284.5

[58] Field of Search ..... 297/397, 188.04, 297/188.06, 391, 284.5, 229; 224/275

[56] References Cited

U.S. PATENT DOCUMENTS

| | | | |
|---|---|---|---|
| 2,566,757 | 9/1951 | Alexander . | |
| 2,953,288 | 9/1960 | Peterson . | |
| 2,979,098 | 4/1961 | Greaves . | |
| 3,608,964 | 9/1971 | Earl | 297/397 |
| 4,097,086 | 6/1978 | Hudson | 297/397 |
| 4,273,380 | 6/1981 | Silvestri . | |
| 4,725,094 | 2/1988 | Greer . | |
| 4,843,662 | 7/1989 | Handelman . | |
| 4,854,637 | 8/1989 | McCree . | |
| 4,877,288 | 10/1989 | Lee . | |
| 5,345,633 | 9/1994 | Harnish | 297/397 |
| 5,503,456 | 4/1996 | Rossini | 297/397 |

*Primary Examiner*—Anthony D. Barfield
*Attorney, Agent, or Firm*—Sidley & Austin

[57] ABSTRACT

An accessory for lounge or patio chairs is disclosed. The accessory comprises a storage bag for conveniently storing a cover for the chair with the chair itself and a bolster for supporting the head, neck, back or legs of a user. The accessory also provides for convenient storage of the bolster with the chair itself as it does for a chair cover. In addition, the storage bag with enclosed chair cover can also act as a pillow to support the back, neck or head of the user when attached to the lounge or patio chair. Also disclosed is a bolster capable of storing a protective cover which can be directly attached to a lounge or patio chair.

2 Claims, 4 Drawing Sheets

LOUNGE CHAIR ACCESSORY

BACKGROUND OF THE INVENTION

Lounge chairs are traditionally used at the beach, pool side, in the backyard, or on outdoor patios to provide a reclining or semi-reclining seat. Typically, a lounge chair consists of a seat and leg support portion fixedly secured to a back support portion which maintains the upper torso of a person's body in a generally upright position. Alternatively, the seat and leg support portion may be adjustably secured to the back support portion allowing the back support portion to be locked into a variety of positions which maintain the upper torso of a person's body in a more or less upright position depending on the desires of the chair's occupant. In addition to lounge chairs, other types of "patio" chairs are commonly utilized at poolside, on outdoor patios, at the beach and elsewhere.

When not in use, lounge and other patio chairs need protection against the elements, i.e., sun, rain, cold, heat, etc. Unfortunately, while it is desirable to cover lounge and patio chairs during periods of non-use or inclement weather, the covers are often in a location remote from the lounge or patio chair, making it very inconvenient to quickly provide the chair with the desired protection. In addition, when using a lounge or patio chair it is often desirable to also use a pillow or pillow-like article, i.e., a bolster, to support the head, neck and/or lower back of the user. Like the chair covers, however, these are likely to be kept in a location remote from the chair itself, again inconveniencing the user. If, on the other hand, the bolster is kept with the chair rather than stored in a remote location, there is the risk that it will become lost during periods of nonuse.

The present invention addresses the problems associated with both the patio and lounge chair covers and bolsters of the prior art by providing a convenient means of storage designed for attachment to the chair itself. The patio or lounge chair accessory provides a storage bag or compartment for holding any one or more of a variety of objects including a protective cover. Preferably, a bolster is releaseably attached to the storage bag. The entire assembly—storage bag and bolster—can be attached to the chair after which its position can be manipulated to serve a number of functions depending on the personal desires of the chair's occupant. In a preferred embodiment, the chair cover is integrally attached to the inside of the storage bag and can be used to quickly cover the patio or lounge chair to which the storage bag is attached. Also provided is an accessory consisting of a bolster which can be attached to the chair and which can be used to store a chair cover.

BRIEF DESCRIPTION OF THE FIGURES

The invention may be more readily understood by reference to the Detailed Description and the following figures wherein like numbers refer to like parts. It is to be understood that the figures are for illustrative purposes only and are not intended to limit the scope of the invention in any way.

DETAILED DESCRIPTION

Figure 1:
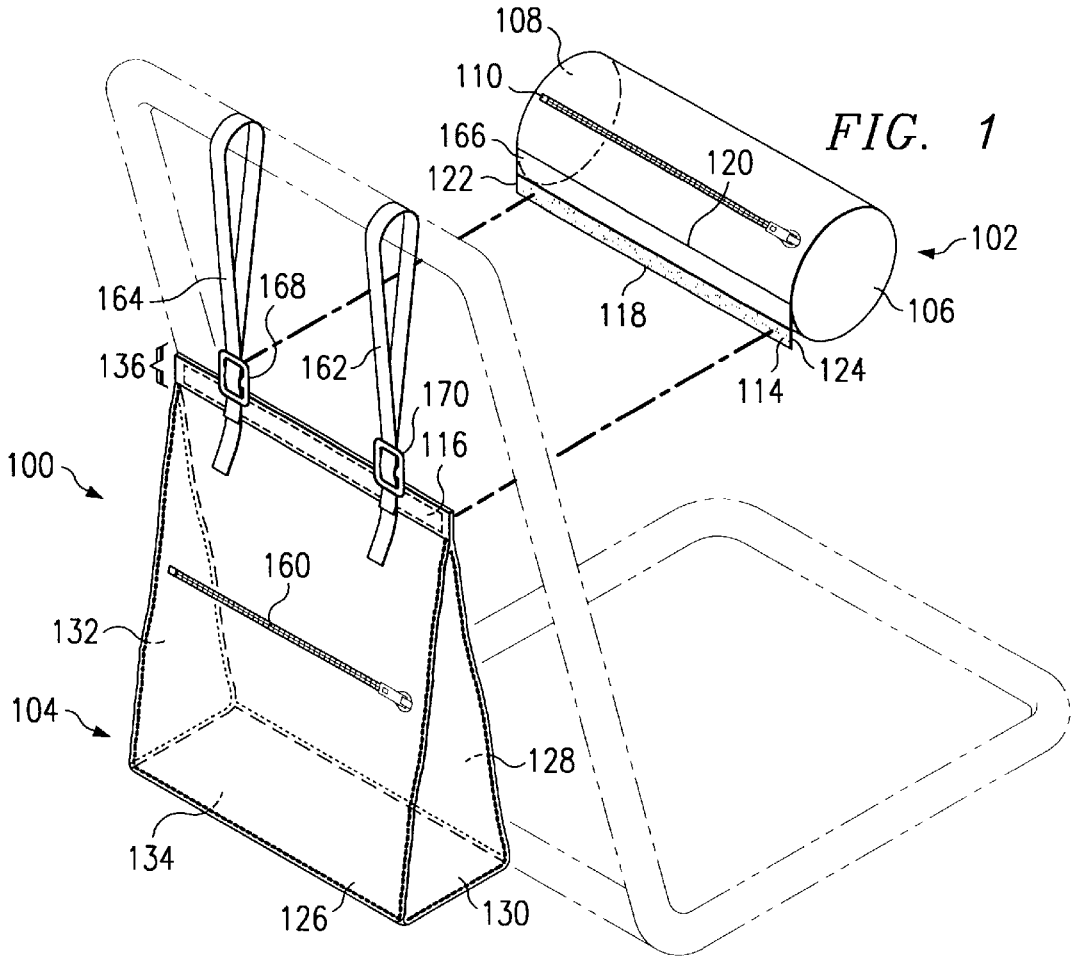
FIG. 1 is a perspective view of one embodiment of the present invention showing how the chair accessory—storage bag and bolster—is attached to a conventional lounge or patio chair.

Referring to FIG. 1, the lounge or patio chair accessory 100 of the present invention includes a head support or bolster 102 which can be removably attached to a storage compartment or bag 104. The bolster 102 is generally cylindrical or columnar in shape and closed at each end by end panels 106 and 108. A zipper 110 or a similar reversibly sealable closure can be provided in the bolster to allow the insertion or removal of a cushion or padding which provides a soft, flexible support for the head of a user or otherwise. The bolster 102 further includes a suitable fastener or fastening device which may be releaseably secured to a complementary fastener or fastening device located on the storage bag 104. In a preferred embodiment, a hook and loop type fastening device commonly known by the trademark VELCRO® (U.S. Pat. No. 3,009,235) is used. In particular, an attachment flap 166 having a VELCRO® strip 114 of a width sufficient to firmly adhere to an oppositely disposed and complementary VELCRO® strip 116 on the storage compartment or bag 104 is used. The attachment flap 166 has a first long edge 118 and a second long edge 120 of equal length and first and second short edges 122 and 124 of equal length. The attachment flap 166, which is generally of the same length as the bolster, is attached thereto by the second long edge 120.

Still referring to FIG. 1, the storage compartment or bag 104 is generally wedge shaped and includes a front panel 126, a back panel 128, a first generally triangularly shaped end panel 130, a second generally triangularly shaped end panel 132 opposite the first generally triangularly shaped end panel 130, and a bottom panel 134. To form the storage bag illustrated in FIG. 1, each of the panels 126, 128, 130, 132 and 134 is stitched or otherwise attached to each of the adjacent panels along its peripheral edges. A two-sided attachment seam 136 is formed along the juncture of the front panel 126 and back panel 128 which aids in securing the accessory 100 to the chair and the bolster 102 to the storage bag 104.

Figure 2:
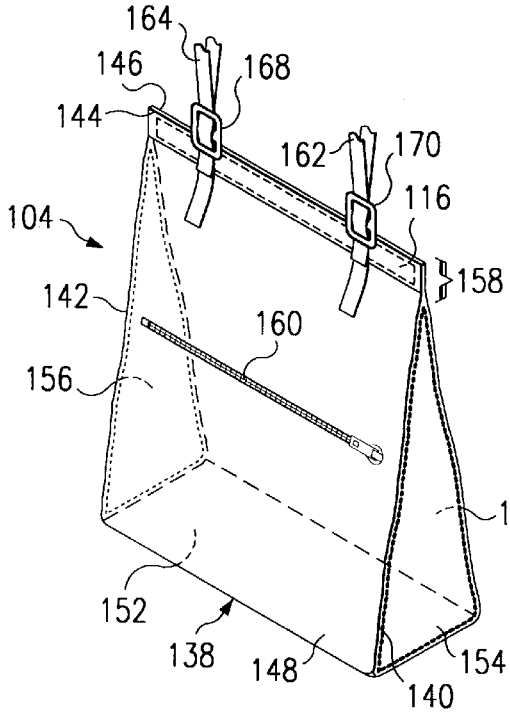
FIG. 2 is a perspective view of the storage bag of FIG. 1 having an alternative construction.

Alternatively, as illustrated in FIG. 2, the storage bag 104 comprises a single rectangular length of material 138 having opposite first and second long edges 140 and 142, and opposite first and second short edges 144 and 146. To form the storage bag 104 in the embodiment illustrated in FIG. 2, the length of material 138 is first folded back upon itself so that the first and second short edges 144 and 146 of the length of material 138 are adjacent and opposite one another such that a front panel 148, a back panel 150, and a bottom panel 152 are all formed by the length of material 138. The bag 104 further comprises a first generally triangularly shaped end panel 154 and a second generally triangularly shaped end panel 156 opposite the first generally triangularly shaped end panel 154. The finished storage bag 104 as illustrated in FIG. 2 is formed by stitching or otherwise attaching each of the end panels 154 and 156 to the length of material 138 (folded as described above) along their peripheral edges and by attaching the first and second short edges 144 and 146 of the length of material 138. In this manner, a two-sided attachment seam 158 is again formed, this time at the juncture of the first and second short edges 144 and 146 of the length of material 138. Although the storage bag 104 is preferably constructed as described herein, other conventional means for manufacturing such a bag may be used.

The storage bag 104 has a zipper 160 or a similar reversibly sealable closure in the front panel 126 or 148, to allow for the storage among other things of a chair cover, which can also act as a pillow, and other articles. The storage bag 104 also has straps 162 and 164 for the attachment of the chair accessory 100 to the back of the chair. The straps 162 and 164 are attached in either a permanent or temporary fashion as later described for accessory 100" to the attachment seam 136 or 158 running along the length of the front panel 126 or 148. For attachment of the bolster 102 to the storage bag 104 a VELCRO® strip 116 is placed along the attachment seam 136 or 158 running along the length of the back panel 128 or 150. The VELCRO® strip 116 is complimentary to the VELCRO® strip 114 located on the attachment flap 166 of the bolster 102. Alternatively, the bolster 102 and storage bag 104 can be attached to one another by other reversible means of attachment, e.g., snaps. In this case, the VELCRO® strip 114 would be replaced by one or more fasteners or fastening devices. Likewise, the VELCRO® strip 116 on the attachment seam 136 or 158 would also be removed. The complimentary portions of the fastener or fastening devices such as snaps would then be placed opposite each other along the attachment flap 166 and the attachment seam 136 or 158 for easy use. Although the description of the specific embodiments disclosed herein may refer solely to the use of VELCRO® fastening devices, it is to be understood that alternative releaseably-engageable fastening devices such as snaps, buckles, zippers or buttons can be freely substituted without altering the invention. Likewise, although the description of the specific embodiments disclosed herein may refer solely to use of straps, it is to be understood that alternative means such as ties can be used to attach the disclosed accessories to the lounge or patio chair.

Figure 3:
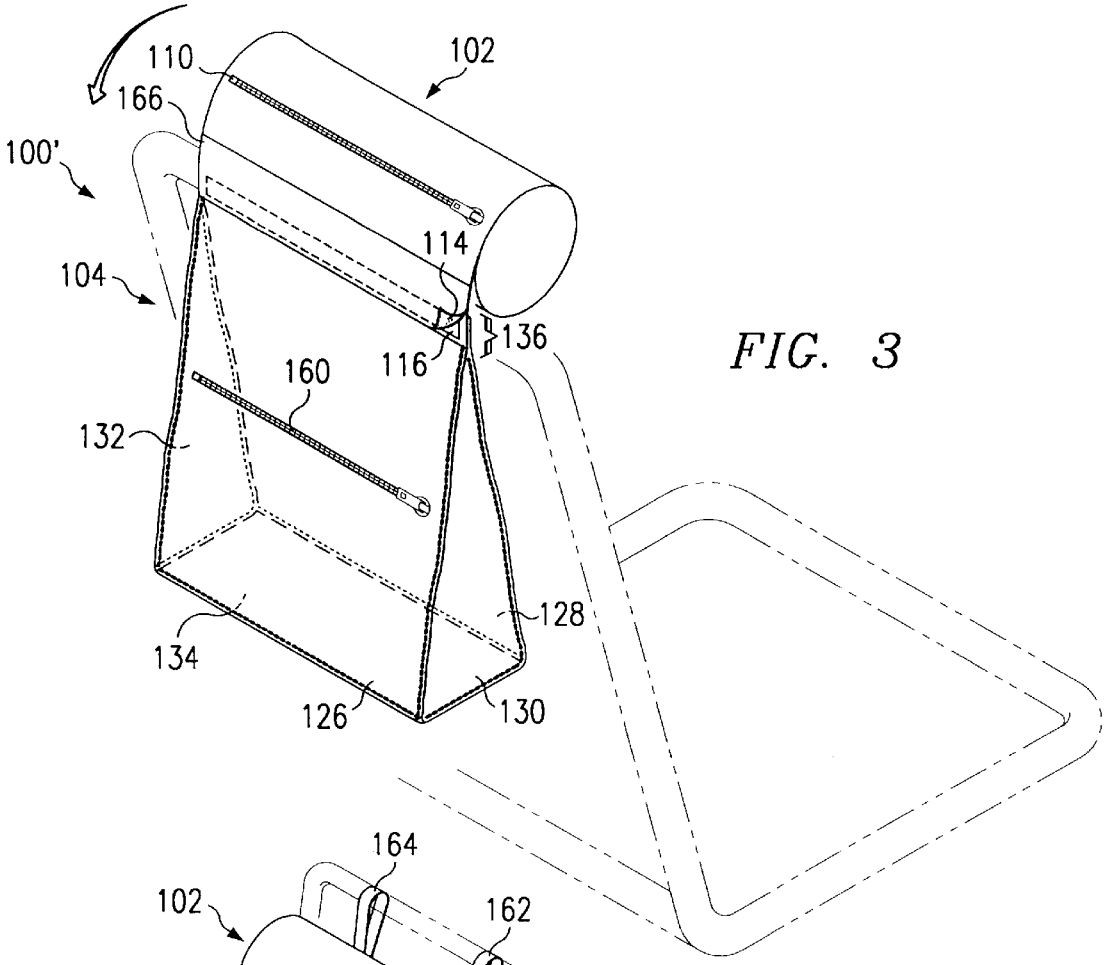
FIG. 3 is a perspective view of an alternative embodiment of the chair accessory of FIG. 1 showing how it is attached to and used with a conventional lounge or patio chair.

In still another embodiment illustrated in FIG. 3, the attachment points of the straps 162 and 164 (not shown) and the VELCRO® strip 116 are reversed on the chair accessory 100'. In this embodiment, the straps 162 and 164 are attached to the part of the attachment seam 136 or 158 running along the length of the back panel 128 or 150 and the VELCRO® strip 116 is attached to the part of the attachment seam 136 or 158 running along the length of the front panel 126 or 148. Otherwise the chair accessory 100' in FIG. 3 is identically constructed as described for the embodiments shown in FIGS. 1 and 2.

Figure 5A:
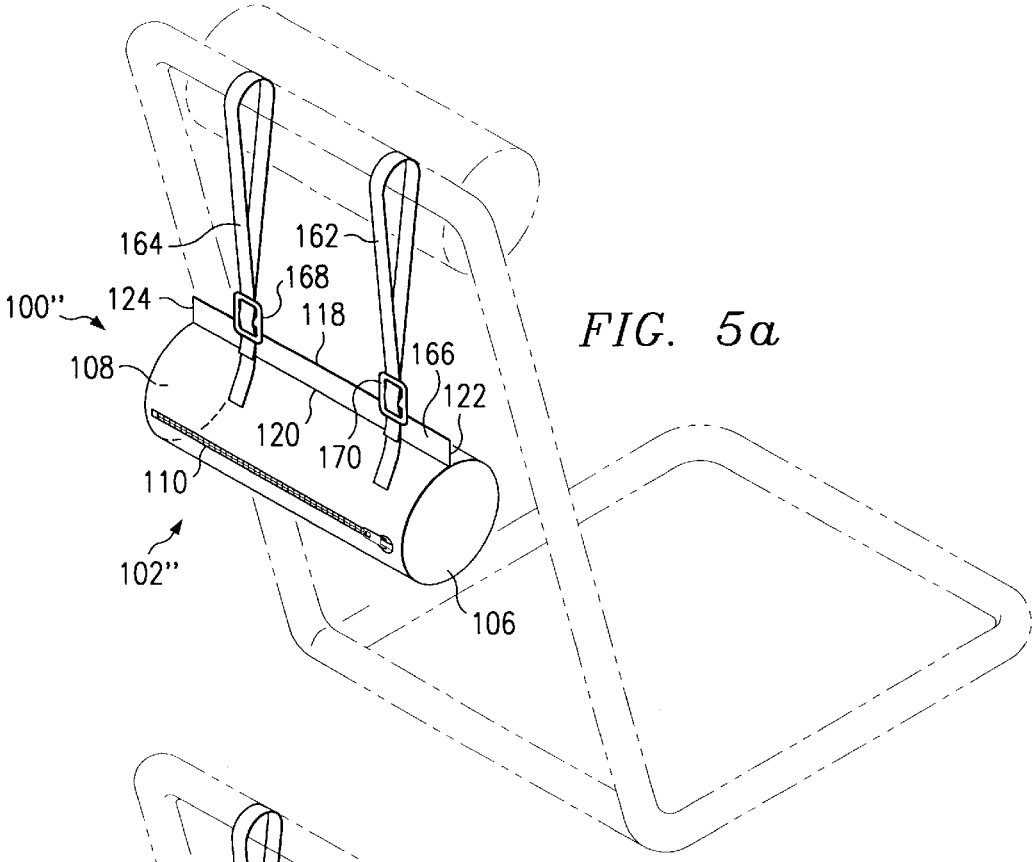
FIGS. 5*a* and 5*b* are perspective views of another embodiment of the present invention illustrating the attachment of straps to the bolster in either a permanent or reversible fashion, respectively.
Figure 5B:
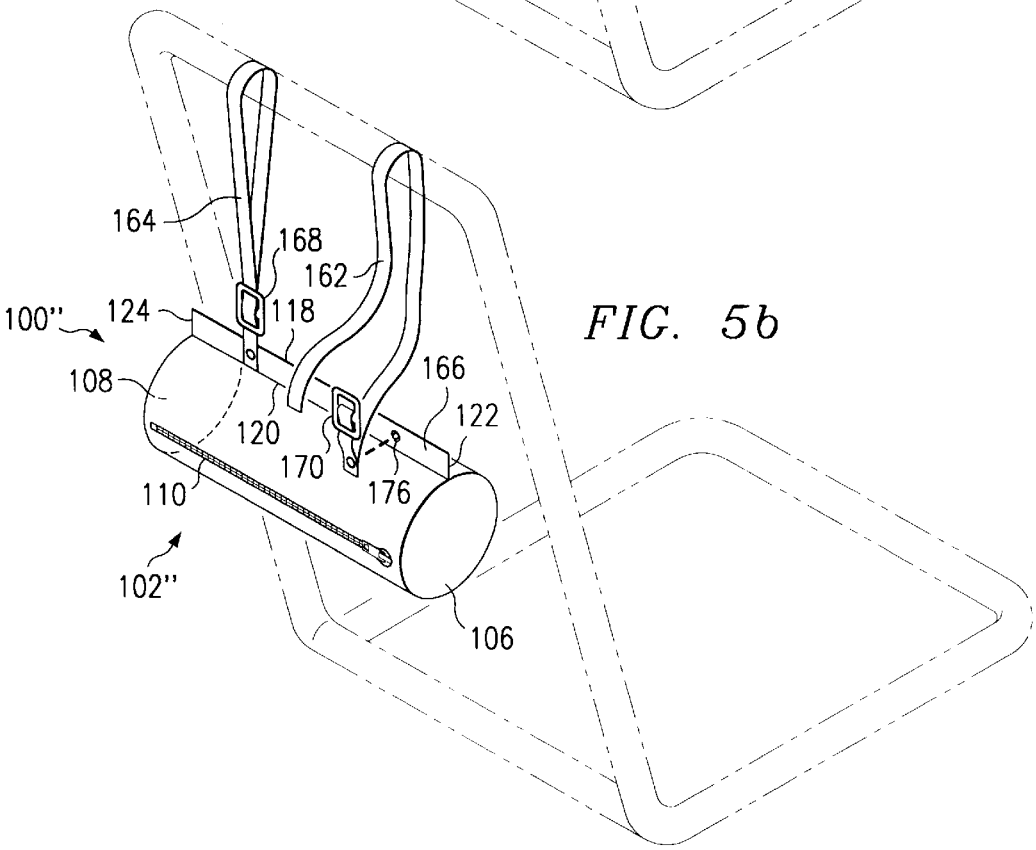

In still another embodiment illustrated in FIGS. 5*a* and 5*b*, the lounge or patio chair accessory 100" includes a bolster 102" to which is directly attached straps 162 and 164. The bolster 102" is generally cylindrical or columnar in shape and closed at each end by end panels 106 and 108. A zipper 110 or a similar reversibly sealable closure can be provided in the bolster 102" to allow the insertion or removal of a cushion or padding which provides a soft, flexible support for the head of a user or otherwise. Preferably, instead of a cushion or padding, the bolster is provided with a chair cover or covers (not shown) which can also act as a soft, flexible support for the head of a user or otherwise when inserted into the bolster 102". The straps 162 and 164 can be attached to bolster 102" in either a permanent or temporary fashion. Preferably, the straps 162 and 164 are permanently attached, e.g., stitched to an attachment flap 166 of the bolster 102". (FIG. 5*a*) The attachment flap 166 has a first long edge 118 and a second long edge 120 of equal length and first and second short edges 122 and 124 of equal length. The attachment flap 166, which is generally of the same length as the bolster 102", is attached thereto by the second long edge 120.

Alternatively, temporary attachment of the straps 162 and 164 to the bolster 102" can be accomplished by attaching suitable fasteners or fastening devices such as snaps 176 to the attachment flap 166 which may be releaseably secured to complementary fasteners or fastening devices located on the straps 162 and 164. (FIG. 5*b*) Examples of suitable fasteners or fastening devices are snaps, zippers, buttons, hooks and loops, and VELCRO®.

In all of the embodiments disclosed herein, both the bolster 102 or 102" and the storage bag 104 are made of a flexible, lightweight material such as canvas or nylon which is water repellant/proof, UV-resistant and/or temperature tolerant. Likewise, in all of the embodiments disclosed herein, the attachment flap 166 can be attached to or formed from the bolster 102 and 102" by any conventional means.

Figure 4:
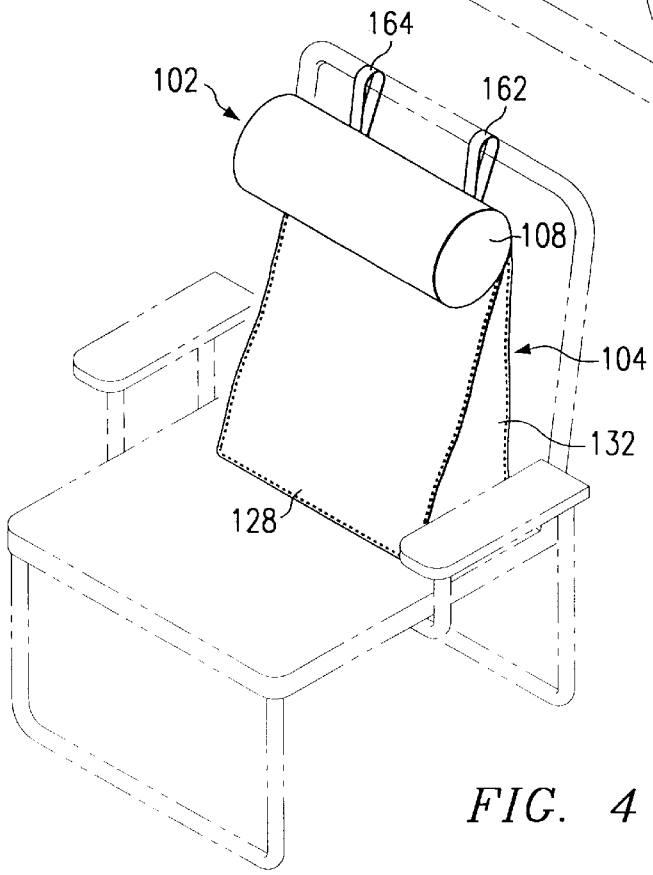
FIG. 4 is a perspective view of the chair accessory of FIG. 1 which has been moved to the other side of the back support of the chair for use as a back and/or head support.

As shown in FIGS. 1 and 4, the accessory 100, which is attached to the chair as illustrated in FIG. 1, can be flipped over so that the front panel 126 or 148 lies along the back of the chair with the bolster 102 attached to and laying on top of the storage bag 104 as shown in FIG. 4. In this manner, the bolster 102 acts as a head or neck rest while the storage bag 104 (with storage cover inside) acts as an upper back support. The position or height of the accessory 100 and therefore the bolster 102 and storage bag 104 along the back of the chair can be adjusted according to the height of the user by use of the straps 162 and 164. Alternatively, the bolster 102 and storage bag 104 can be used independently of each other. For example, the bolster 102 can be used as a head or neck support or a back support while the storage bag 104 is left to hang behind the back of the chair as illustrated in FIG. 1. In addition, the storage bag 104 can be positioned as illustrated in FIG. 4 and used as a head or neck support while the bolster 102 is separated and used as a lower back or even as a leg support. Finally, it is also possible for one person to use the storage bag 104, for example, as a head rest while the occupant of another chair uses the bolster 102 for a head, neck or back support.

The accessory 100', also consisting of a bolster 102 and a storage bag 104, is attached to a lounge chair as illustrated in FIG. 3. As shown, the bolster 102 can be used as a head support. If a head support is undesired, the bolster 102 is simply flipped to the back out of the way of the chair's occupant but within easy reach where it remains attached to the storage bag 104 as previously described, e.g., by VELCRO® strips 114 and 116. It is also possible with this embodiment for one person to use the bolster 102 for a head, neck or back support while the storage bag 104 is flipped over so that the front panel 126 lies along the back of the chair where it can act as a head, neck and/or back support for the occupant of the chair to which it is attached. To allow for an adjustment of the position of the bolster 102 along the back of the chair, the width of the attachment flap 166 can be adjusted as shown in FIG. 3.

Accessory 100", which consists of a bolster 102" and attachment straps 162 and 164, is attached to a lounge chair as illustrated in FIGS. 5*a* and 5*b*. As shown, the bolster 102" can be used as a head support. If a head support is undesired, the bolster 102" is simply flipped back to hang behind the chair out of the way of the chair's occupant but within easy reach. Alternatively, the removably attached bolster 102" can be used by the occupant of another chair as a head, neck and/or back support.

Figure 6A:
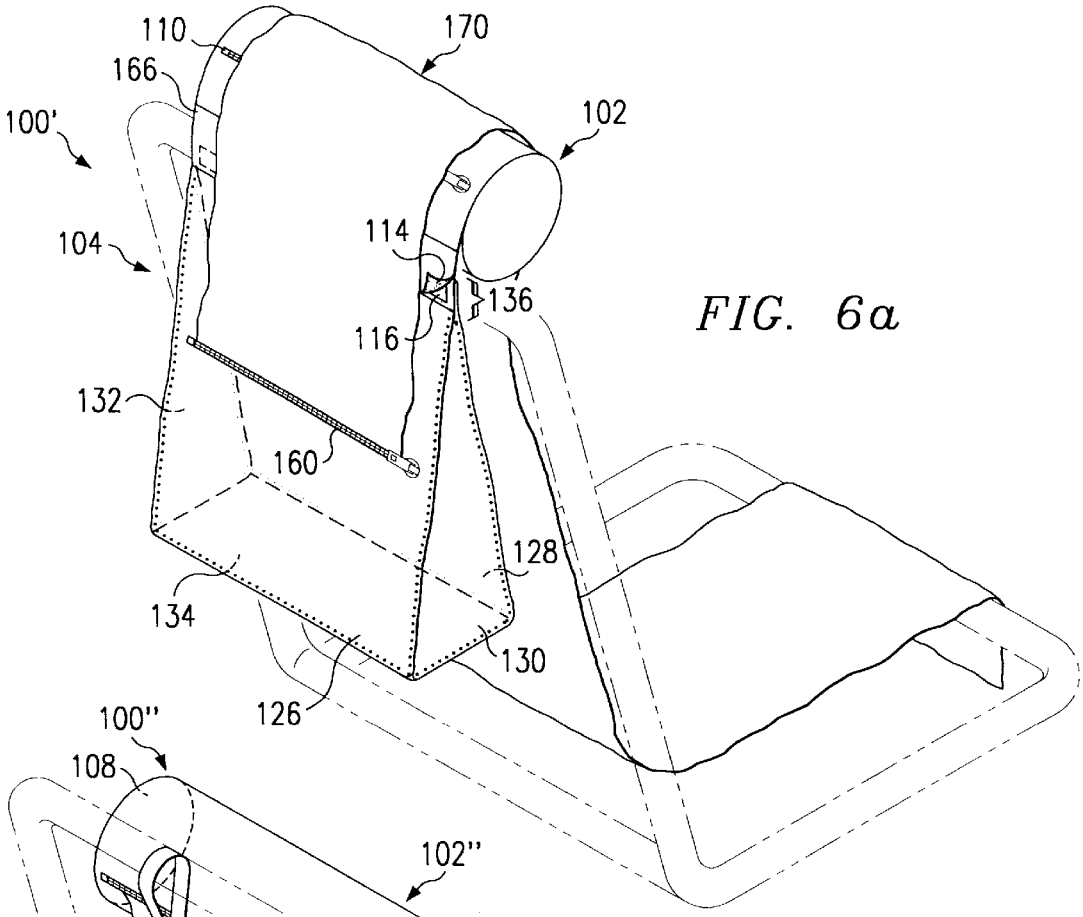
FIGS. 6*a* and 6*b* are perspective views of another embodiment of the present invention illustrating the use of a chair cover along with the chair accessory storage bag and bolster.
Figure 6B:
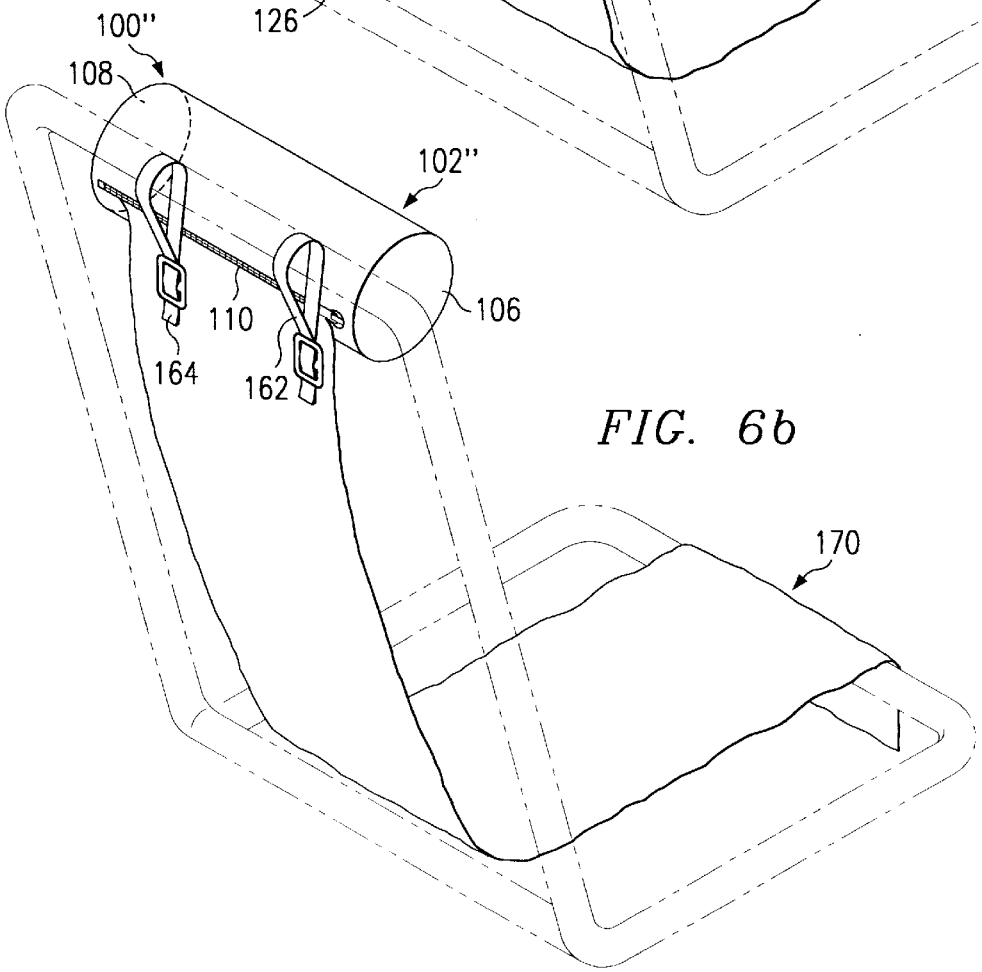

In two additional embodiments depicted in FIGS. 6*a* and 6*b,* respectively, the storage bag 104 or bolster 102" further comprises a chair cover 170 integrally attached to the inside of the storage bag 104 or bolster 102" such that it can be pulled out of the storage bag 104 or bolster 102" and placed over the seat, leg and back support portions of the chair to which the storage bag 104 or bolster 102" is attached.

I claim:

1. An apparatus for use with a patio chair, said patio chair having a chair frame comprising a horizontal top rail, two vertical side rails attached to said top rail, and a back support portion attached between said horizontal top rail and said two vertical side rails, said apparatus comprising:

a bolster;

a chair cover integrally attached to said bolster;

at least two elongated straps attached to said bolster for attaching said bolster to said chair frame, said straps being of sufficient length to be looped around said horizontal top rail of said chair frame, whereby said straps allow said bolster to be flipped over said top rail of said chair frame from a first configuration to a second configuration;

wherein said first configuration positions said bolster adjacent a first side of said back support portion of said chair frame whereby said bolster provides support for a person sitting in said chair;

wherein said second configuration positions said bolster adjacent a second side of said back support portion of said chair frame; and wherein each of said straps further comprises an adjustment means whereby the length of each of said straps can be independently adjusted so that the position of said bolster in relation to said back support portion of said chair frame can be adjusted along both the vertical and horizontal axes of said back support portion.

2. A patio chair apparatus comprising:

a chair frame having a horizontal top rail, two vertical side rails attached to said top rail, and a back support portion attached between said horizontal top rail and said two vertical side rails;

a storage bag having at least two panels connected together to form an inner storage cavity adapted for the storage of a chair cover and a variety of other articles, said inner storage cavity having a reversibly-sealable closure and a chair cover, said chair cover being integrally attached to said storage bag;

a bolster having an inner support member and an outer enclosure defining a bolster cavity, said bolster having an opening of sufficient size to permit insertion of said inner support member into said bolster cavity;

said storage bag having at least two independently adjustable straps, each independently adjustable strap having a first end attached to said storage bag and a second end attached to said horizontal top rail of said chair frame; and said bolster being removably attachable to said storage bag by at least one releasably-engageable fastening device.

* * * * *